US010857794B2

(12) United States Patent
Nakamura et al.

(10) Patent No.: US 10,857,794 B2
(45) Date of Patent: Dec. 8, 2020

(54) LIQUID EJECTION HEAD AND MANUFACTURING METHOD OF LIQUID EJECTION HEAD

(71) Applicant: CANON KABUSHIKI KAISHA, Tokyo (JP)

(72) Inventors: Yohei Nakamura, Yokohama (JP); Toru Nakakubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/385,847

(22) Filed: Apr. 16, 2019

(65) Prior Publication Data

US 2019/0344567 A1 Nov. 14, 2019

(30) Foreign Application Priority Data

May 8, 2018 (JP) ..... 2018-090134

(51) Int. Cl.
*B41J 2/14* (2006.01)
*B41J 2/16* (2006.01)

(52) U.S. Cl.
CPC ..... *B41J 2/14233* (2013.01); *B41J 2/14201* (2013.01); *B41J 2/161* (2013.01); *B41J 2002/14459* (2013.01); *B41J 2002/14491* (2013.01); *B41J 2202/12* (2013.01); *B41J 2202/20* (2013.01)

(58) Field of Classification Search
CPC ..... B41J 2/14233; B41J 2/14201; B41J 2002/14491; B41J 2002/14459; B41J 2202/12; B41J 2/14072
See application file for complete search history.

(56) References Cited

U.S. PATENT DOCUMENTS

| | | | | |
|---|---|---|---|---|
| 8,579,412 | B2 | 11/2013 | Bibl et al. | |
| 8,789,924 | B2 | 7/2014 | Bibl et al. | |
| 9,283,758 | B2 | 3/2016 | Horiguchi | |
| 2014/0192118 | A1* | 7/2014 | Cruz-Uribe | B41J 2/045 347/71 |
| 2015/0130877 | A1 | 5/2015 | Takabe | |

FOREIGN PATENT DOCUMENTS

| | | | |
|---|---|---|---|
| CN | 103619599 | A | 3/2014 |
| CN | 104924763 | A | 9/2015 |
| JP | 2011-520670 | A | 7/2011 |

OTHER PUBLICATIONS

Office Action dated Sep. 27, 2020, in Chinese Patent Application No. 201910365708.X.

* cited by examiner

*Primary Examiner* — Geoffrey S Mruk
(74) *Attorney, Agent, or Firm* — Venable LLP

(57) ABSTRACT

There is provided a liquid ejection head whose resolution may be enhanced without narrowing a wiring pitch, and a manufacturing method thereof. To that end, integrated circuits are arranged on a same substrate as that of piezoelectric elements.

8 Claims, 9 Drawing Sheets

LIQUID EJECTION HEAD AND MANUFACTURING METHOD OF LIQUID EJECTION HEAD

BACKGROUND OF THE INVENTION

Field of the Invention

The present invention relates to a liquid ejection head configured to eject liquid from a plurality of ejection ports and a manufacturing method of the liquid ejection head.

Description of the Related Art

There is known a method that uses an ejection energy generating element as a device for ejecting liquid from an ejection port of a liquid ejection head to generate pressure in a pressure chamber, and uses the pressure to eject liquid in the pressure chamber from the ejection port formed at one end of the pressure chamber. Such a liquid ejection head, having an electric contact on each piezoelectric element and heating element, and being connected to an integrated circuit that generates a drive signal, performs ejection by driving an energy generating element such as a piezoelectric element or a heating element by a drive signal. In addition, such a liquid ejection head is often configured so that an integrated circuit is connected to wiring on the liquid ejection head via a flexible print circuit (referred to as FPC, in the following). However, arranging the ejection ports over the liquid ejection head with a high density to perform printing with a high precision results in reduction of the connection region between the FPC and the wiring of the liquid ejection head, whereby implementation thereof becomes difficult.

Japanese Patent Laid-Open No. 2011-520670 has disclosed therein a liquid ejection head including: a pressure chamber sandwiched between a supply flow path and a collection flow path; an electric wiring connecting an energy generating element and an integrated circuit provided on a upper part of the collection flow path; and an integrated circuit provided at an end of a substrate and connected to the electric wiring. Accordingly, the electric wiring from each electric contact needs only be routed within the liquid ejection head, whereby it becomes possible to easily provide connection even in the case where the connection region between the FPC and the liquid ejection head is narrow.

However, in the case of enhancing the liquid ejection head with a much higher resolution by the method of Japanese Patent Laid-Open No. 2011-520670, increase of the number of electric wirings as well as the number of ejection ports requires a narrower wiring pitch for drawing the electric wiring from each ejection port to the integrated circuit on the substrate, because of the limited region available for wiring.

SUMMARY OF THE INVENTION

Therefore, the present invention provides a liquid ejection head whose resolution may be enhanced without narrowing a wiring pitch, and a manufacturing method thereof.

To that end, the liquid ejection head of the present invention includes: a plurality of ejection ports configured to eject liquid; energy generating devices configured to generate energy to be used for ejecting liquid from the ejection ports; and integrated circuits configured to transmit, to the energy generating devices, an electric signal for driving the energy generating devices, where the ejection ports and the energy generating devices are respectively arranged as columns, and the integrated circuits and the energy generating devices are provided on a same substrate.

According to the present invention, it is possible to realize a liquid ejection head whose resolution may be enhanced without narrowing the wiring pitch, and the manufacturing method thereof.

Further features of the present invention will become apparent from the following description of exemplary embodiments with reference to the attached drawings.

DESCRIPTION OF THE EMBODIMENTS

First Embodiment

In the following, a first embodiment of the present invention will be described, referring to drawings.

Figure 1A:
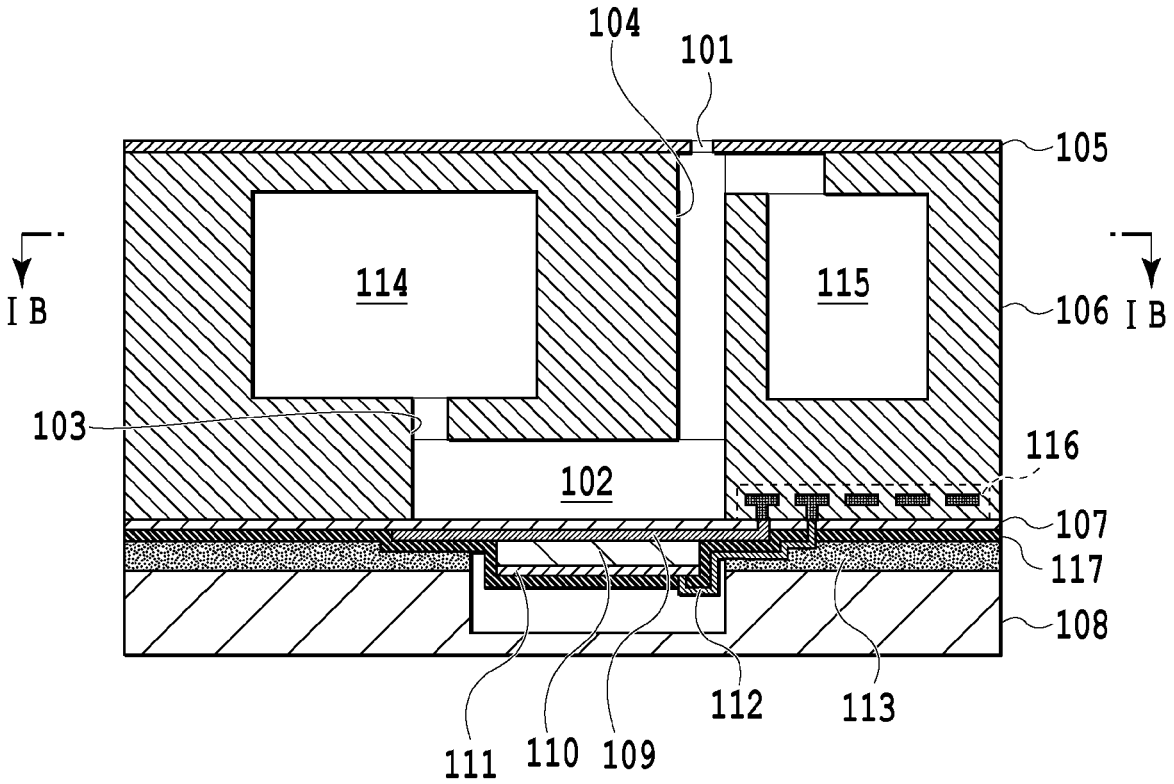
FIG. 1A is a cross-sectional view of an ejection unit.
Figure 1B:
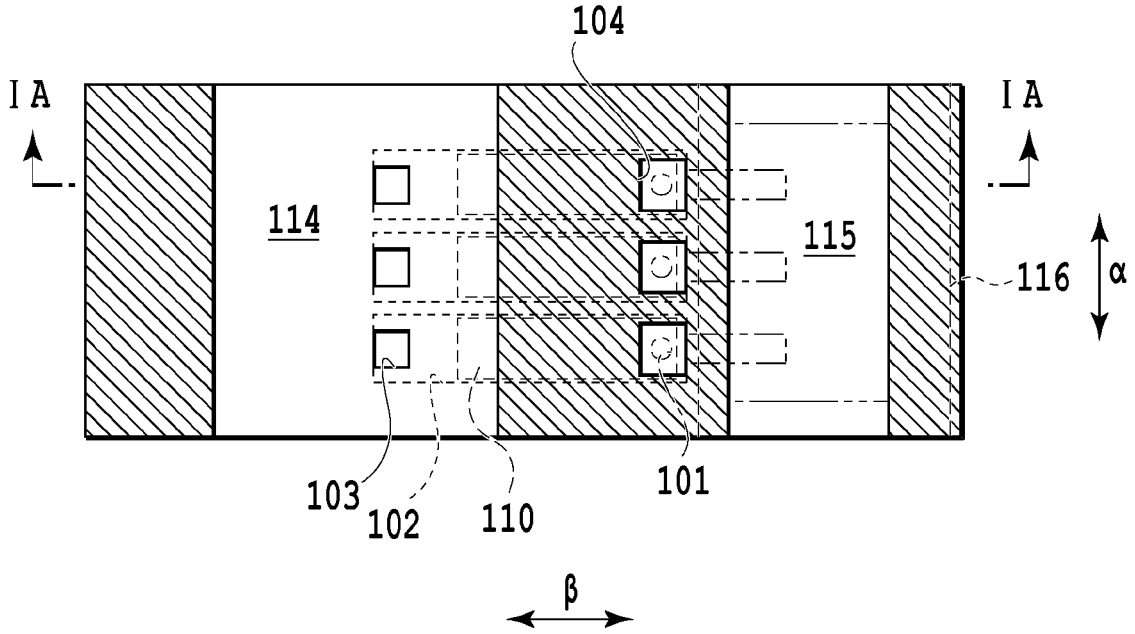
FIG. 1B is a plan view of a surface including ejection ports.

FIG. 1A is a cross-sectional view of an ejection unit of a liquid ejection head 100 to which the present embodiment is applicable, and FIG. 1B is a perspective plan view of a surface including ejection ports 101. The liquid ejection head 100, having an energy generating mechanism based on a piezoelectric element 110, is formed by lamination of an individual electrode 111, the piezoelectric element 110, a common electrode 109, and a vibration plate 107. The vibration plate 107, being formed on a flow path substrate 106, forms a wall surface of a pressure chamber 102. The pressure chamber 102 has ink supplied thereto from a common ink supply flow path 114 through a squeezing part 103. Upon application of voltage to the individual electrode 111, distorting of the piezoelectric element 110 causes the vibration plate 107 to bend. Accordingly, energy for ejecting ink in the pressure chamber 102 is generated. The pressure chamber 102 is in communication with a common ink collection flow path 115 via a communication port 104, so that ink circulates therein. Furthermore, the ejection ports 101 formed on an ejection port substrate 105 are in communication with the communication port 104, and pressure generated by the piezoelectric element 110 directly acts on the pressure chamber 102 to eject ink from the ejection ports 101, whereby printing is performed on a print medium.

A plurality of the ejection ports 101 are arranged as an ejection port column, the ejection port column being provided along the common ink supply flow path 114 and the common ink collection flow path 115. In addition, the piezoelectric elements 110, being provided corresponding to the ejection ports 101, are also arranged as a column. The pressure chamber 102 is formed in a manner overlapping with a part of the common ink supply flow path 114 in a direction perpendicular to the surface on which the ejection ports 101 are formed, whereby it is possible to arrange the ejection ports 101 with a high density. The flow path substrate 106 has integrated circuits 116 provided thereon, each of the integrated circuits 116 being connected to the individual electrode 111 by a draw-out wiring 112.

In addition, the integrated circuits 116 are formed at a position overlapping with the common ink collection flow path 115 in the vicinity of the pressure chamber 102, in a direction perpendicular to the surface on which the ejection ports 101 are formed. In other words, the integrated circuits 116 are arranged along the column of the piezoelectric elements 110. It suffices that the integrated circuit 116 overlaps with at least one of the common ink supply flow path 114 or the common ink collection flow path 115. The common electrode 109 and the draw-out wiring 112 are electrically insulated by an insulating film 117. The insulating film 117 has joined thereto, via adhesive 113, a supporting substrate 108 having a cavity for protecting the piezoelectric element 110 and regulating a transformation region of the vibration plate 107.

In the present embodiment, the integrated circuit 116, and a piezoelectric element unit including the common electrode 109, the piezoelectric element 110, and the individual electrode 111 are provided in the proximity to each other sandwiching the vibration plate 107, so that both the integrated circuit 116 and the piezoelectric element unit are provided on the vibration plate 107.

As thus described, the integrated circuit 116 and the piezoelectric element unit are installed on the same substrate, and the integrated circuit 116 is provided along the column of the piezoelectric elements 110. Accordingly, it becomes unnecessary to draw, on the substrate, the draw-out wiring 112 connecting the integrated circuit 116 and the piezoelectric element unit, thereby significantly reducing the areas required for drawing the wiring.

The supporting substrate 108 has provided thereon, at an end of the ejection port column, a common ink supply port for supplying ink to the common ink supply flow path 114 and a supplied-ink collection port for collecting ink from the common ink collection flow path, which are piped to the outside of the liquid ejection head 100 so as to circulate ink.

The integrated circuit 116 has input thereto, from the outside of the liquid ejection head 100, voltage for driving the piezoelectric elements 110, and a selection signal for selecting one or more of the piezoelectric elements 110 corresponding to one or more of the ejection ports 101 that perform ejection. The integrated circuit 116, having a switching circuit including a transistor corresponding to each of the piezoelectric elements 110, may apply voltage to the selected one or more of the piezoelectric elements 110, based on the selection signal.

The ejection ports 101 form an ejection port column aligned in a direction indicated by the arrow α in FIG. 1B, with the common ink supply flow path 114 and the common ink collection flow path 115 being provided along the ejection port column. In the ejection port column, the ejection ports 101 are arranged in a manner shifted relative to each other in a direction indicated by the arrow β in FIG. 1B in accordance with the print resolution. In the case of a liquid ejection head with a resolution of 2400 dpi, for example, the ejection ports 101 are shifted relative to each other by 10.6 μm.

Figure 2:
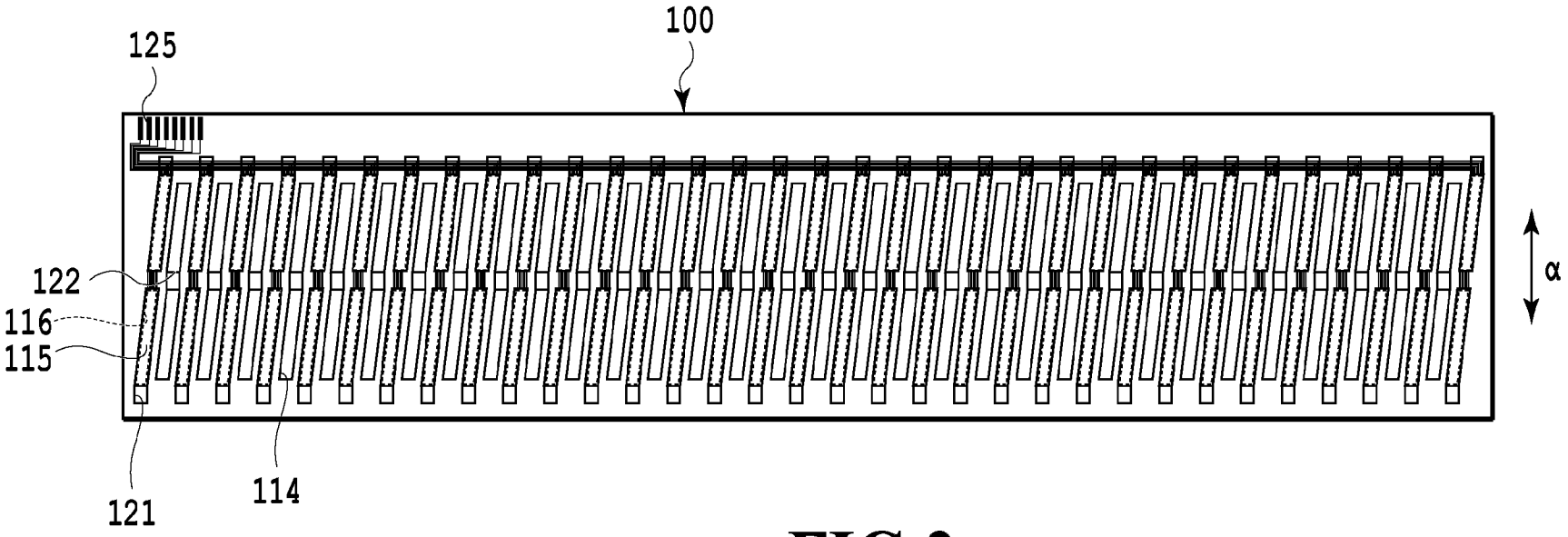
FIG. 2 is a perspective plan view of a liquid ejection head.
Figure 3:
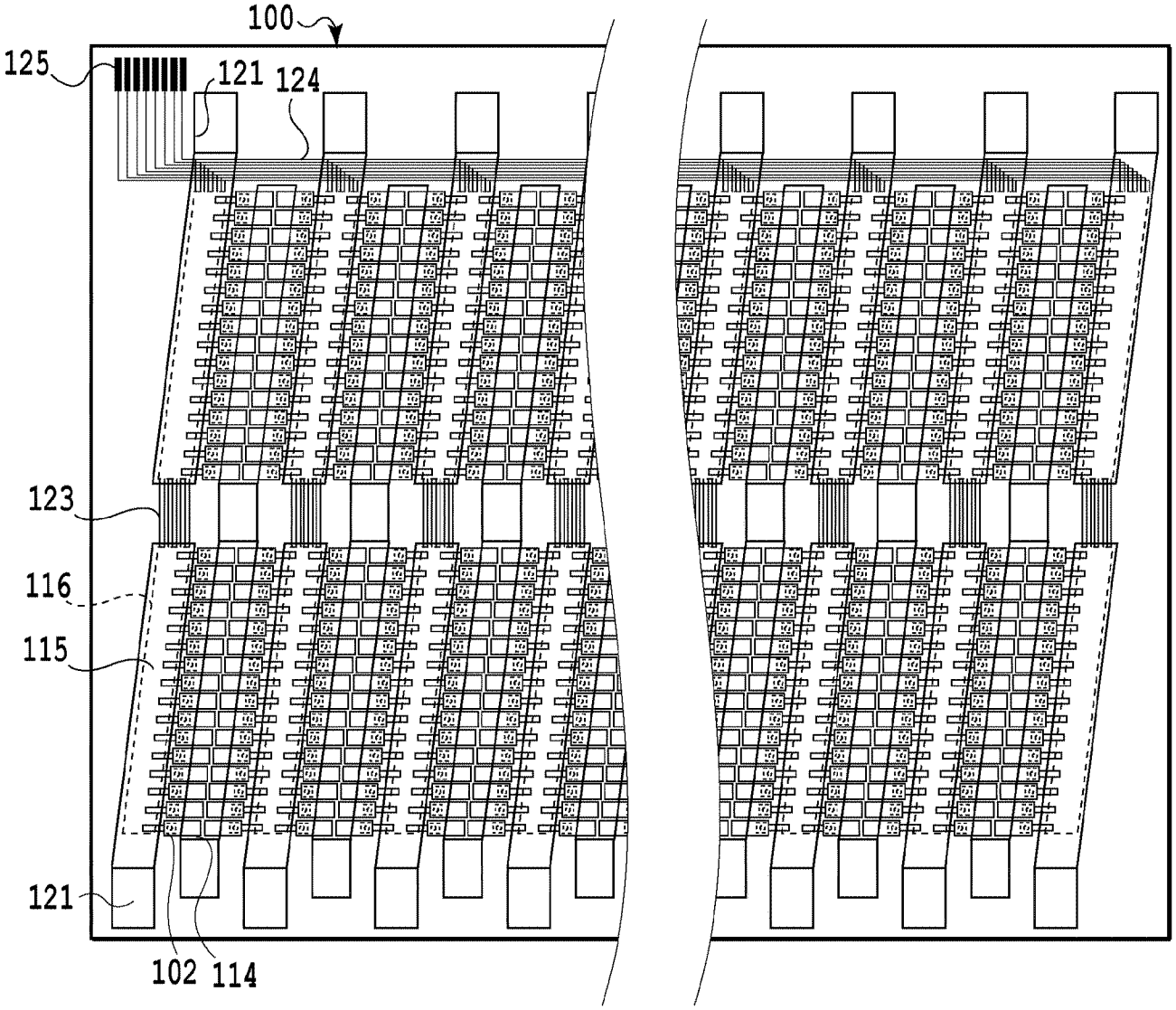
FIG. 3 is an enlarged view of the liquid ejection head.

FIG. 2 is a perspective plan view of the liquid ejection head 100, and FIG. 3 is an enlarged view of the liquid ejection head 100. The liquid ejection head 100 has the common ink supply flow path 114 and the common ink collection flow path 115 formed thereon along the ejection port column. From each of the common ink supply flow paths 114, ink is supplied to two ejection port columns, and the ink is intended to be collected from the two ejection port columns to each of the common ink collection flow paths 115. The ejection port column is provided in a manner divided into an upper and a lower block at the central part of the liquid ejection head 100 in a direction indicated by the arrow α.

A common ink supply port 122 formed on the flow path substrate 106 and the supporting substrate 108 is provided at the aforementioned central part, whereby ink is supplied from the common ink supply port 122 to each of the common ink supply flow paths 114. In addition, a common ink collection port 121 formed on the flow path substrate 106 and the supporting substrate 108 is provided on the upper and the lower ends of the ejection port column, whereby ink in each of the common ink collection flow paths 115 is collected from the common ink collection port 121.

The common ink supply ports 122 and the common ink collection ports 121 are alternately arranged at positions facing the region in which the pressure chamber 102 is formed, whereby it is possible to supply and collect ink easily. The reason for dividing into blocks as thus described is because a large number of the ejection ports 101 in an ejection port column makes the common ink supply flow paths 114 longer and the flow resistance higher, which results in a pressure distribution due to pressure loss, and an uneven ejection performance depending on the position of the ejection port 101. Dividing the ink supply path into two, namely, the upper and the lower blocks as described in the present embodiment allows for reducing the flow resistance in the common ink supply flow path 114.

The integrated circuit 116 (indicated by the dashed line in FIG. 3) is formed at a position overlapping with each of the common ink collection flow paths 115, seen from a direction perpendicular to a surface on which the ejection ports are formed, in the vicinity of the pressure chamber 102. Wirings 123 and 124 connected to the integrated circuit 116 are connected to an attaching terminal 125. Providing the common ink collection flow path 115 and the integrated circuit 116 at an overlapping position as thus described, allows for releasing together with ink, through the common ink collection flow path 115, the heat generated by the integrated circuit 116 while the integrated circuit 116 is being driven to the outside of the liquid ejection head 100. In addition, providing the integrated circuit 116 along the column of the piezoelectric elements 110 may shorten the drawing of the wirings 123 and 124, and reduce the electric resistance. Furthermore, the wirings 123 and 124 from the integrated circuit 116 and the attaching terminal 125 may be formed on the same layer as that of the draw-out wiring 112, and electric resistance may be reduced by making the layer thicker, whereby daisy chain connection becomes possible with a small number of wirings.

An ejection port column includes 64 ejection ports with the upper and the lower blocks combined, and therefore a total of 4096 ejection ports may be formed with a pitch of 2400 npi (nozzles per inch) by arranging, for example, 64 ejection port columns. In such a case, the numbers of the common ink supply flow paths 114 and the common ink collection flow paths 115 arranged turn out to be 32 and 33, respectively. The integrated circuits 116 respectively apply an electric signal to energy generating elements corresponding to the 32 ejection ports 101 arranged in two ejection port columns of either the upper or the lower block.

Figure 4:
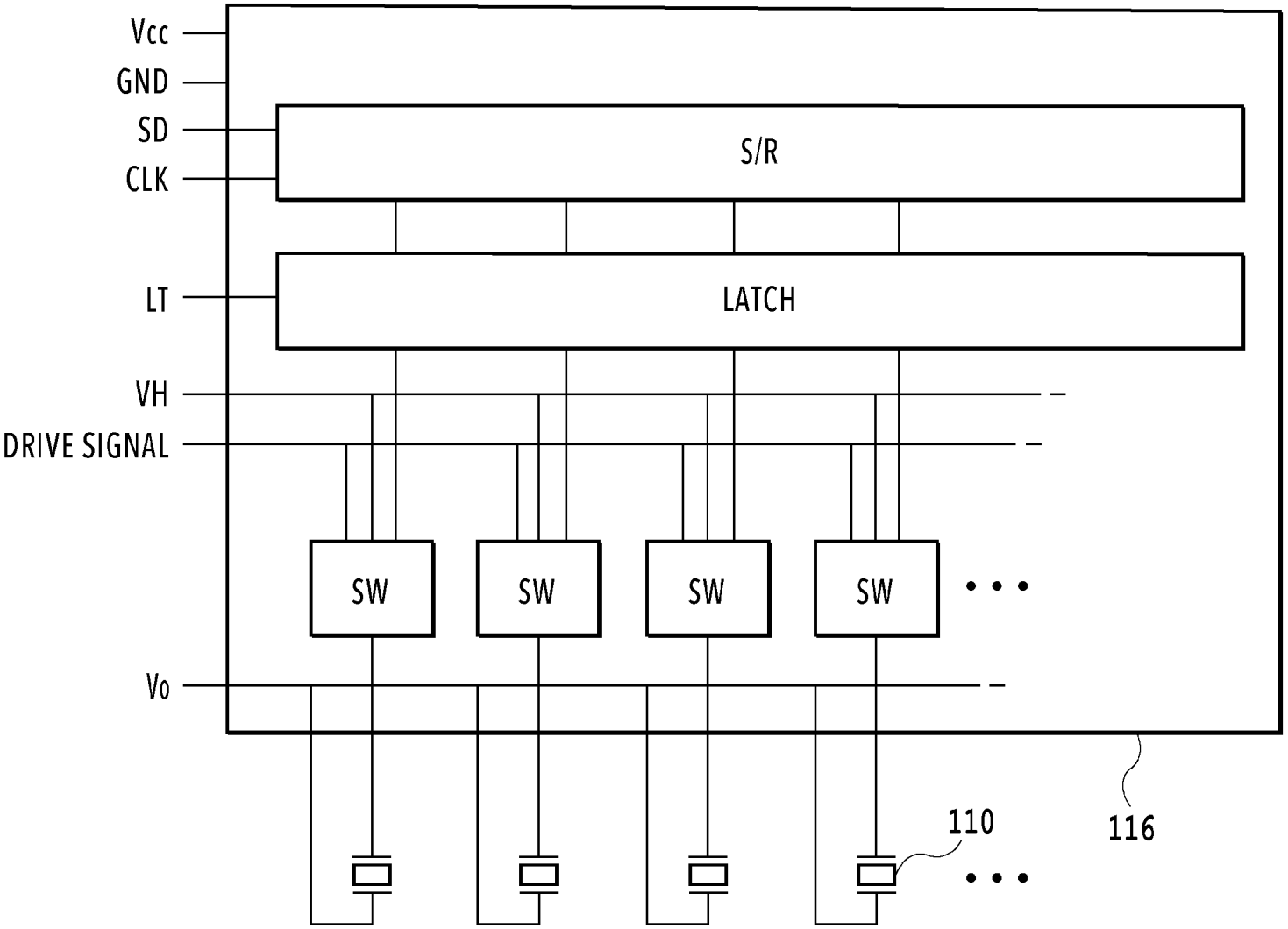
FIG. 4 is a block diagram of an integrated circuit.

FIG. 4 is a block diagram of the integrated circuit 116. First, a clock (CLK) and serial data (SD) are input to a shift register (S/R), and the data is latched with a latch signal (LT) being a trigger. A switching element (SW) is On/Off-driven by an analog power source (VH) on the basis of the latched data, and the input drive wave pattern (Drive Signal) is applied to the piezoelectric element 110.

Although the present embodiment assumes a configuration in which the common ink supply port is provided at the central part of the liquid ejection head 100, the present invention is not limited thereto. In the case of a 1200 npi liquid ejection head, for example, the length of the common ink supply flow path becomes half of the case of a 2400 npi, which results in a lower flow resistance, and there may be a configuration with the common ink supply port provided at the upper end of the liquid ejection head and the common ink collection port at the lower end without division into blocks. Considering the flow path resistance of ink circulation, it is desirable that either the common ink supply port or the supplied-ink collection port is an opening with a larger area.

In addition, although the supply ports and collection ports are arranged for each common flow path in FIG. 3, it is also possible to provide a wide opening across a plurality of common flow paths. In addition, there may be a configuration in which the common ink supply flow path 114 and the common ink collection flow path 115 are reversed, that is, the integrated circuit 116 may be formed in a manner overlapping with the common ink supply flow path 114. Furthermore, the present invention may also be applied to a liquid ejection head having only the ink supply flow path formed thereon, unlike the configuration in which ink circulates within the liquid ejection head, whereby a similar effect of reducing the number of wirings may be obtained.

Figure 5:
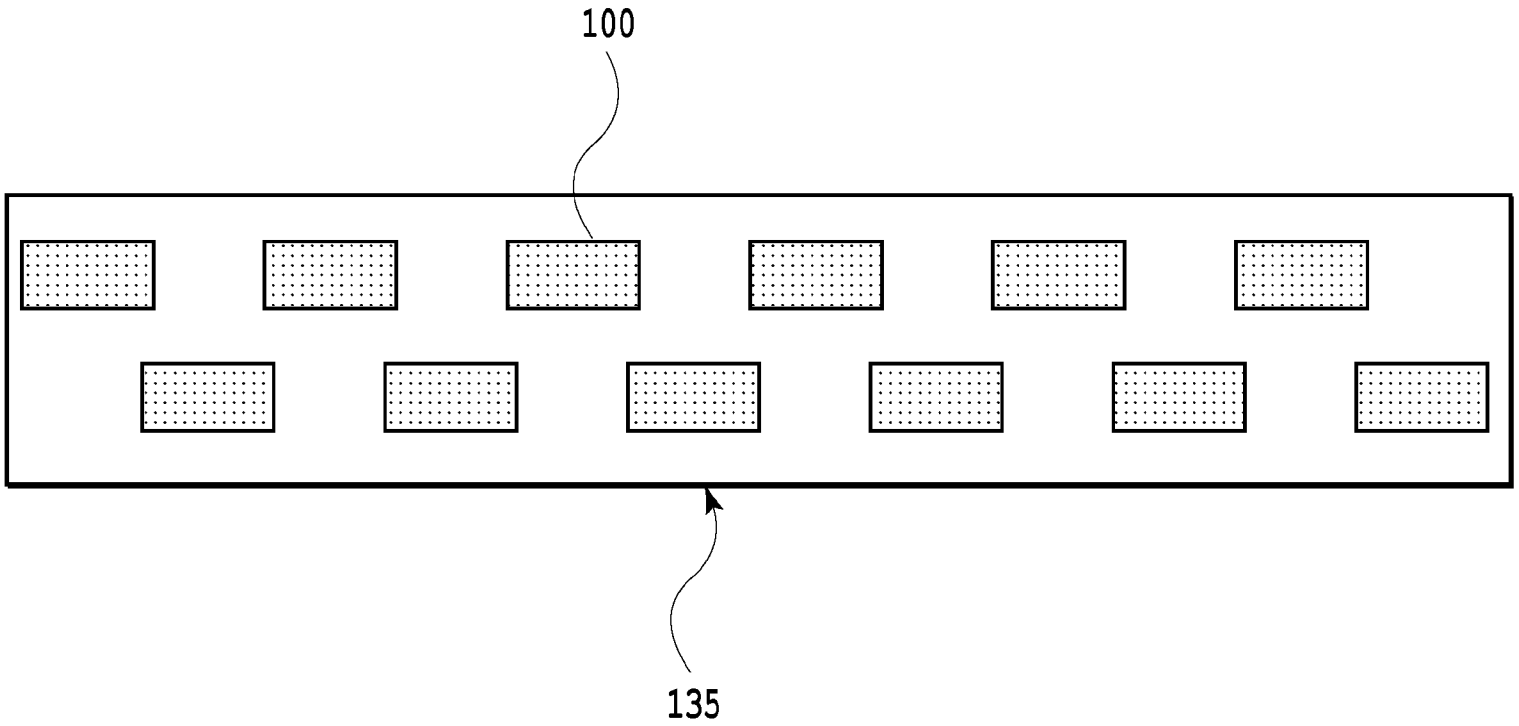
FIG. 5 illustrates a line head using the liquid ejection head.

FIG. 5 illustrates a line head 135 using the liquid ejection heads 100 of the present embodiment. As illustrated, it is possible to configure the line head 135 to be long by arranging the liquid ejection heads 100 alternately in the longitudinal direction of the line head so that the ends thereof overlap with each other. Since only a small number of wirings extend out from the liquid ejection head 100, it is possible to use an FPC with a narrow width, thereby facilitating the arrangement of the liquid ejection head 100.

Figure 6:
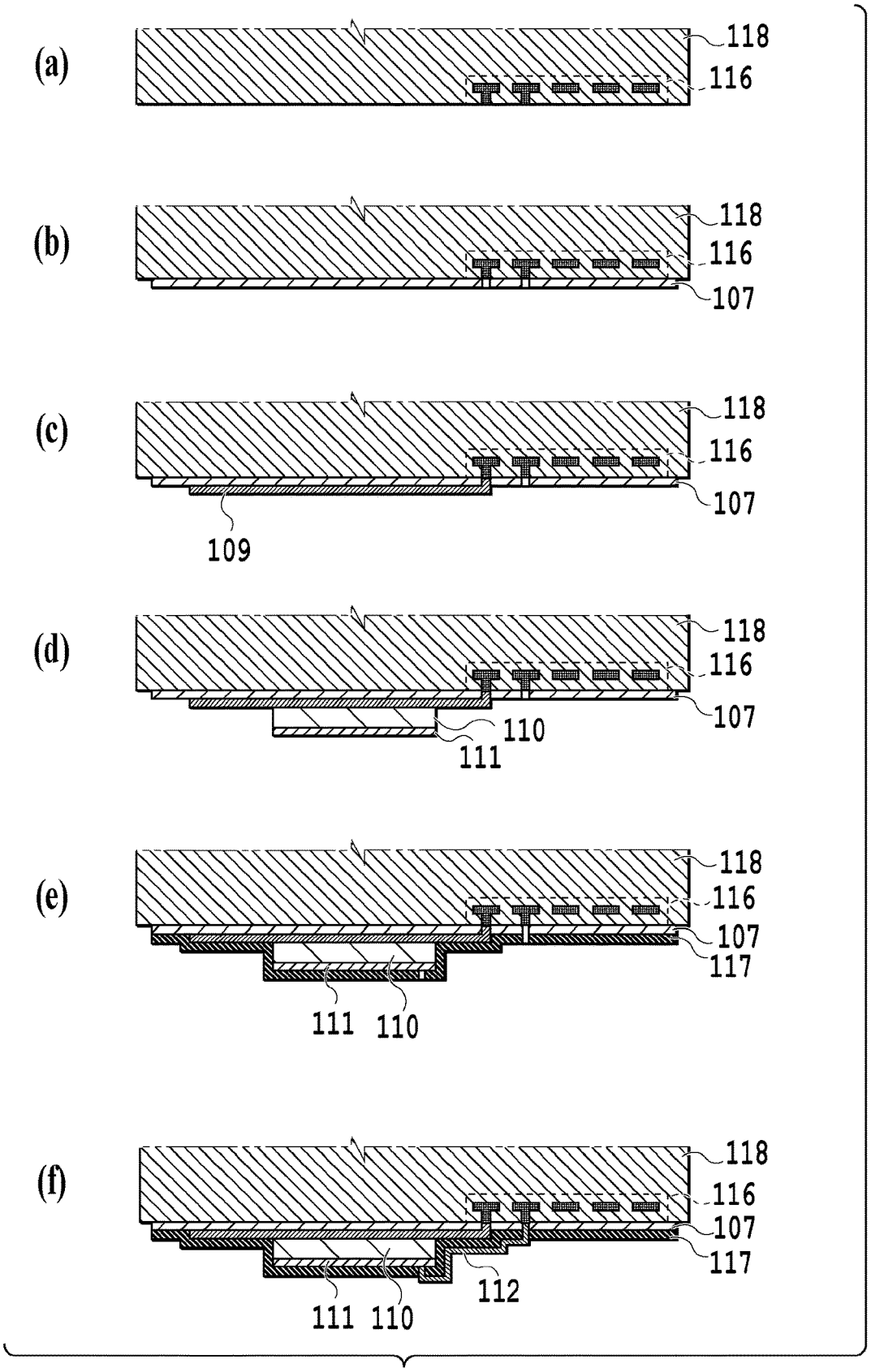
FIG. 6 illustrates a manufacturing method of the liquid ejection head in the order of processing.
Figure 7:
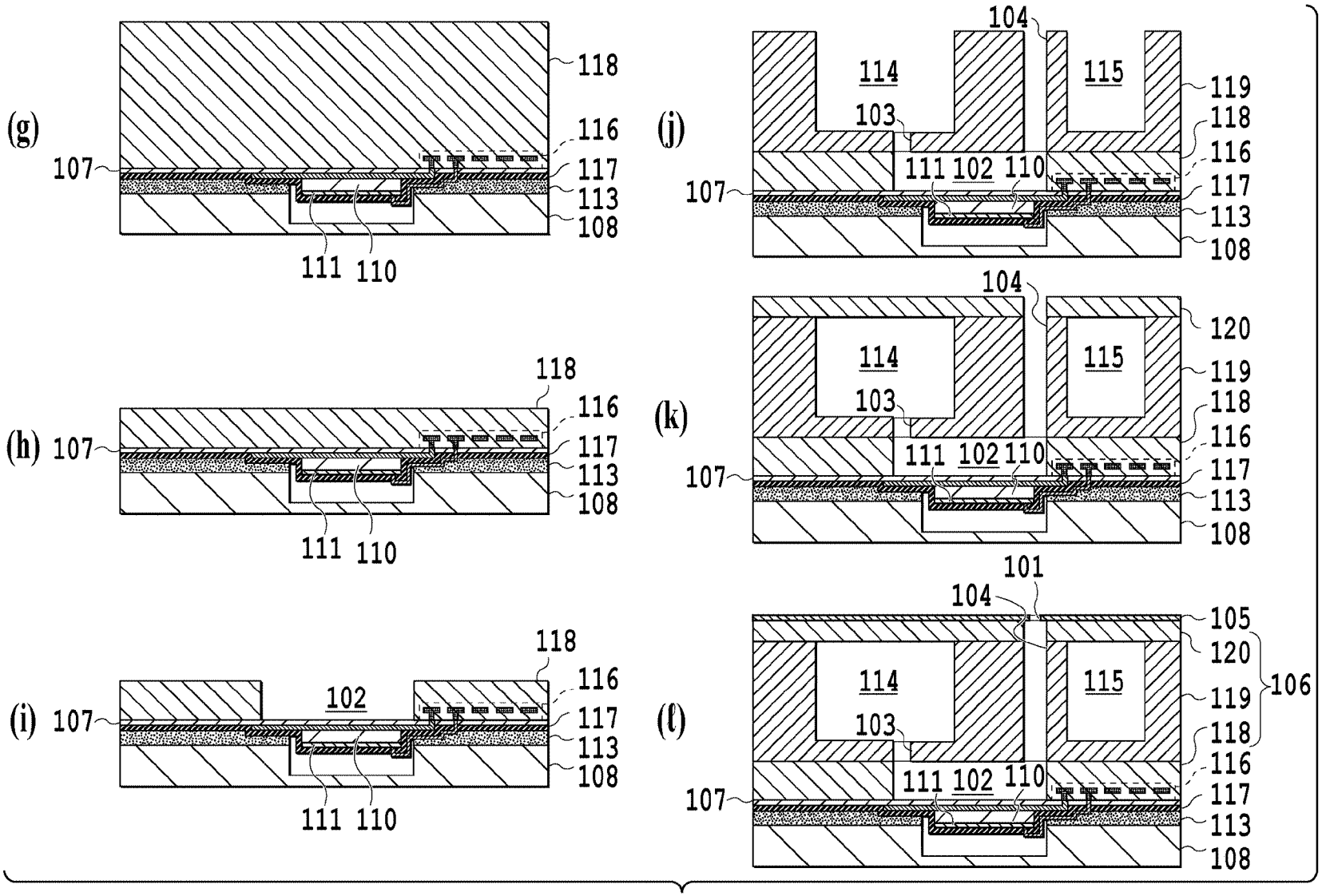
FIG. 7 illustrates the manufacturing method of the liquid ejection head in the order of processing.

FIG. 6 and FIG. 7 illustrate a manufacturing method of the liquid ejection head 100 in the order of processing. In the following, the manufacturing method of the liquid ejection head 100 will be described in the order of processing. First, as illustrated in a part (a) of FIG. 6, the integrated circuit 116 having a switching circuit including transistors is formed on a first flow path substrate 118 made of Si. The integrated circuit 116 may be formed using a CMOS process (integrated circuit forming process). Subsequently, as illustrated in a part (b) of FIG. 6, SiN which forms the vibration plate 107 is deposited by plasma CVD on a surface on which the integrated circuit 116 of the first flow path substrate 118 has been formed, subjected to patterning so that an electrode connecting part of the integrated circuit 116 is exposed. Then, as illustrated in a part (c) of FIG. 6, Pt, which forms the common electrode 109, is deposited by sputtering and subjected to patterning.

Subsequently, lead zirconate titanate (PZT), which forms the piezoelectric element 110, is deposited by a low-temperature sputtering process at a temperature equal to or lower than 500° C. on the common electrode 109 subjected to patterning, and further the individual electrode 111 is deposited by sputtering, and subjected to patterning (see a part (d) of FIG. 6). Here, since the substrate having the integrated circuit 116 formed thereon requires deposition and annealing at a temperature equal to or lower than 500° C., the low-temperature sputtering process is effective. Thus, as illustrated in a part (e) of FIG. 6, SiO2, which forms the electrically insulating film 117, is deposited by plasma CVD over the vibration plate 107 on the integrated circuit 116, and subjected to patterning so that the individual electrode 111 and an electrically connecting part of the integrated circuit 116 are exposed. Finally, an energy generating element capable of applying voltage to the piezoelectric element 110 in response to an electric signal from the integrated circuit 116 is formed by patterning the draw-out wiring 112 that electrically connects the integrated circuit 116 and the individual electrode 111 (energy generating device forming process) (see a part (f) of FIG. 6). Note that the materials and deposition methods presented here are not limited thereto.

Next, a method of forming a flow path in the liquid ejection head 100 will be described. As illustrated in a part (g) of FIG. 7, the supporting substrate 108 having a cavity for regulating displacement of the vibration plate provided on the first flow path substrate 118 is adhesively joined with the adhesive 113. The supporting substrate 108 has the common ink supply port 122 and the common ink collection port 121 (see FIG. 2) formed thereto. Subsequently, the first flow path substrate 118 is thinned by a polishing process as illustrated in a part (h) of FIG. 7, and the pressure chamber 102 is formed by dry etching (see a part (i) of FIG. 7). A separately prepared second flow path substrate 119 has the common ink supply port flow path 114, the common ink collection flow path 115, the squeezing part 103, and the communication port 104 formed on the Si substrate by double-sided etching. The second flow path substrate 119 is joined on the first flow path substrate 118 to match the position of the pressure chamber 102 (see a part (j) of FIG. 7). Forming the integrated circuit 116 and the piezoelectric element 110, which is an energy generating device, directly on the first flow path substrate 118 as thus described allows for shortening the length of the draw-out wiring 112 connecting the two. Accordingly, it becomes possible to suppress expansion of the wiring region even in a head having a relatively large number of ejection ports such as a page-wide type line head.

Subsequently, as illustrated in a part (k) of FIG. 7, a third flow path substrate 120 having formed thereon a flow path connecting the communication port 104 and the common ink collection flow path 115 is joined to the second flow path substrate 119. As thus described, the flow path substrate 106 turns out to have a three-layer configuration of the first flow path substrate 118, the second flow path substrate 119, and the third flow path substrate 120. The ejection port substrate 105 having the ejection ports 101 formed thereon (ejection port formation) is joined to the flow path substrate 106 to form the liquid ejection head 100.

As thus described, the integrated circuit 116 is provided along the column of piezoelectric elements 110 in the vicinity of the piezoelectric element 110 on the same substrate. Accordingly, the distance of drawing the draw-out wiring 112 is shortened, whereby wiring over a limited region of the substrate has become unnecessary. As a result, there have been realized a liquid ejection head whose resolution may be enhanced without narrowing the wiring pitch, and a manufacturing method thereof.

Second Embodiment

In the following, a second embodiment of the present invention will be described, referring to the drawings. Note that the basic configuration of the present embodiment is similar to that of the first embodiment and therefore only characteristic components will be described below.

Figure 8:
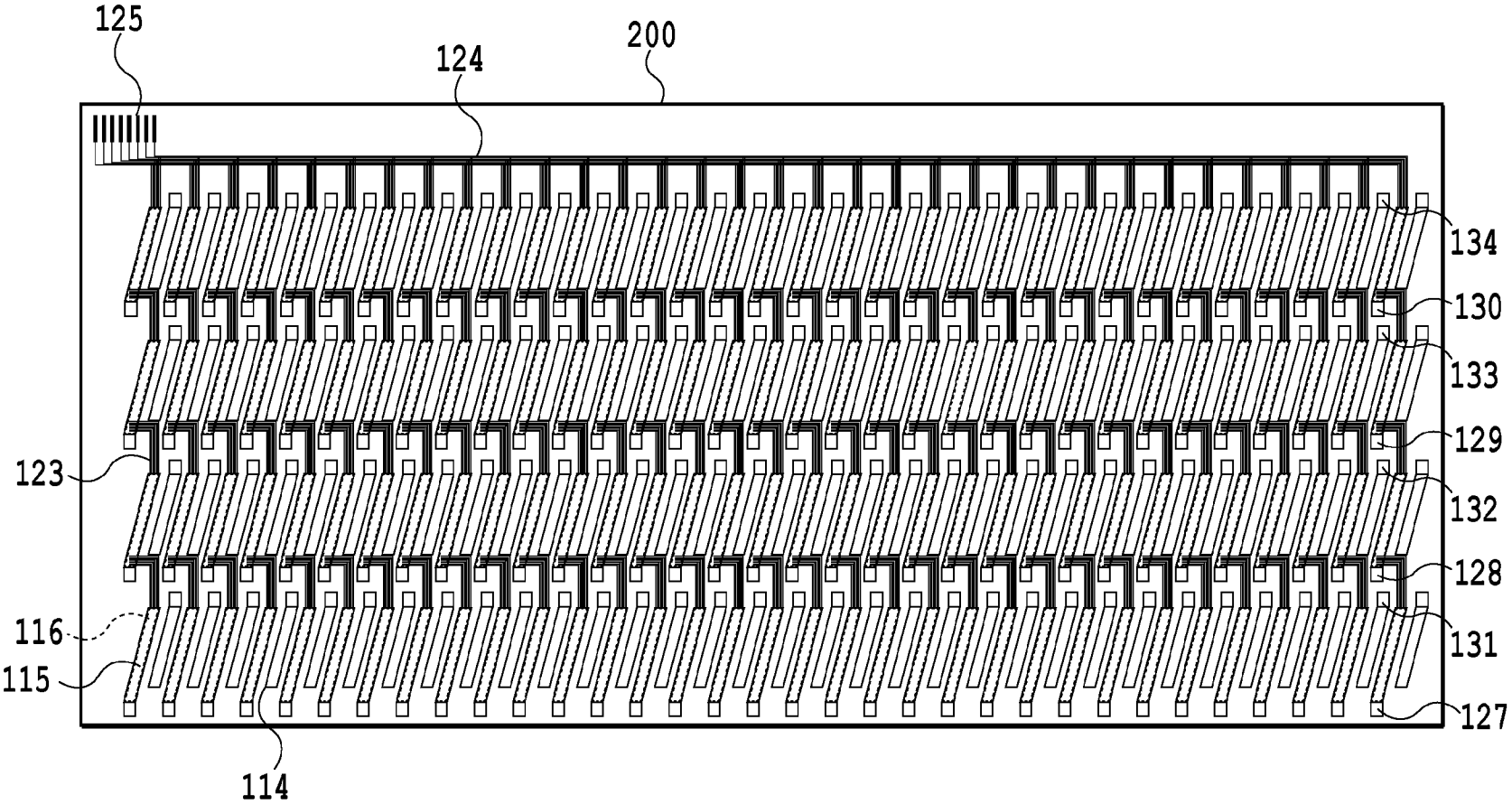
FIG. 8 is a perspective plan view illustrating the liquid ejection head.

FIG. 8 is a perspective plan view illustrating a liquid ejection head 200 of the present embodiment. The liquid ejection head 200 of the present embodiment is capable of ejecting different types of liquid. The common ink supply flow paths 114 and the common ink collection flow paths 115 are arranged along an ejection port column, and the integrated circuits 116 are further formed at positions overlapping with the common ink collection flow paths 115. The ejection port columns are divided into four blocks in the vertical direction, with common ink supply ports (131, 132, 133, 134) for supplying different types of liquid and common ink collection ports (127, 128, 129, 130) for collecting different types of liquid being arranged for respective blocks.

The wirings 123 are configured in a manner connecting the integrated circuits 116 between the blocks, and being connected through the common ink supply ports (131, 132, 133, 134) and the common ink collection ports (127, 128, 129, 130) so as to allow a same signal to be applied to all the blocks. Such a configuration allows for ejecting, from a single liquid ejection head, ink of four colors, cyan, magenta, yellow, and black, which are used for color printing, for example.

Another Example

Figure 9:
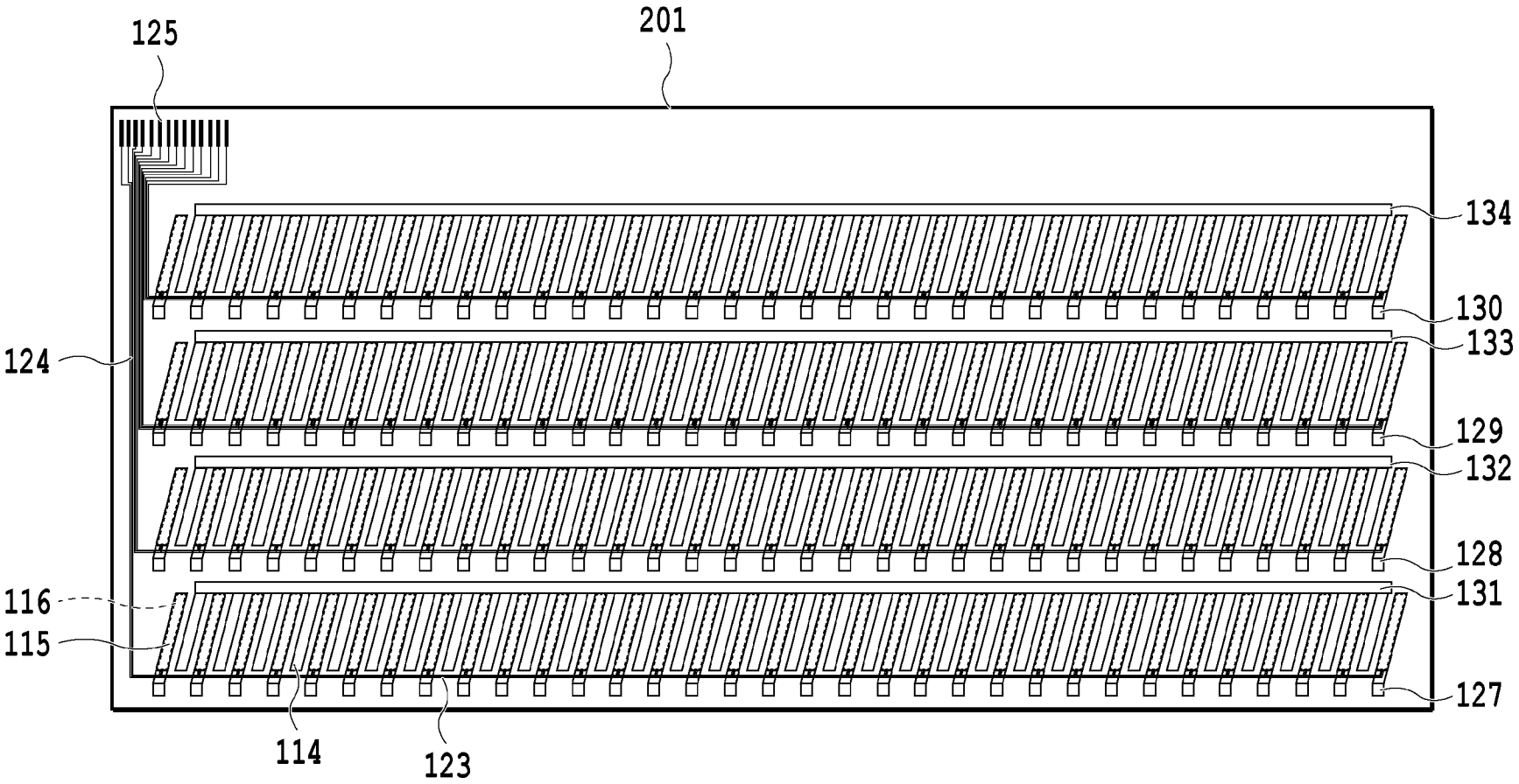
FIG. 9 is a perspective plan view illustrating a liquid ejection head of another example.

FIG. 9 is a perspective plan view illustrating a liquid ejection head 201 of another example. In the present example, the wirings 123 are grouped for each block, i.e., for each ink color, and connected to the attaching terminal 125 by the wirings 124. Such a wiring configuration allows for inputting different serial data or drive wave patterns for each ink, whereby it is possible to adjust ejection properties across blocks even in the case of using ink with different physical properties.

The common ink supply ports (131, 132, 133, 134), which are wide openings in communication with all the ejection port columns for each block, are configured to have small flow path resistance. Note that, although the configuration causes the wiring 123 to pass between collection ports with a narrow opening area and ejection port columns, it is also possible to provide the wiring even at the supply port side with a wide opening area, and it is further possible to divide the wiring between both openings. Since the common ink supply flow paths and the common ink collection flow paths are formed on the flow path substrate, the entire region where piezoelectric elements, the common ink supply ports, and the common ink collection ports are not formed is available as the wiring region. In addition, although there has been described an example in which the common ink supply ports and the common ink collection ports are alternately arranged relative to the ejection ports, the present invention may also be applied to a configuration in which they are arranged on the same side.

As thus described, the piezoelectric elements 110 and the integrated circuits 116 are arranged in the vicinity thereof on the same substrate, the integrated circuits 116 are provided along the columns of piezoelectric elements 110 in the vicinity thereof, and the ejection port columns are arranged in a manner divided into four blocks. Accordingly, there have been realized a liquid ejection head which is capable of ejecting a plurality of different types of ink and whose resolution may be enhanced without narrowing the wiring pitch, and a manufacturing method thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-090134 filed May 8, 2018, which is hereby incorporated by reference herein in its entirety.

What is claimed is:

1. A liquid ejection head comprising:

a plurality of ejection ports configured to eject liquid;

energy generating devices configured to generate energy to be used for ejecting liquid from the ejection ports;

integrated circuits configured to transmit, to the energy generating devices, electric signals for driving the energy generating devices;

a first substrate provided with ejection port columns in which the ejection ports are arranged, and energy generating device columns in which the energy generating devices are arranged; and a second substrate on which energy generated by the energy generating devices acts, and including pressure chambers that communicate with the ejection ports, supply flow paths that supply liquid to the pressure chambers, and collection flow paths that collect liquid from the pressure chambers, wherein at least a part of the integrated circuits overlap with the collection flow paths and the integrated circuits do not overlap with the supply flow paths when viewed from a direction perpendicular to a surface on which the ejection ports are provided.

2. The liquid ejection head according to claim 1, wherein the integrated circuits are arranged along the energy generating device columns, and the supply flow paths and the collection flow paths are arranged along the ejection port columns.

3. The liquid ejection head according to claim 1, wherein a part of the supply flow paths and the pressure chambers overlap with each other in a direction perpendicular to a surface on which the ejection ports are formed.

4. The liquid ejection head according to claim 1, wherein the first substrate is joined to the second substrate so as to form a wall of a part of the pressure chamber, and works as a vibration plate which bends due to drive of the energy generating devices.

5. The liquid ejection head according to claim 4, wherein the integrated circuits and the energy generating devices are provided on different surfaces of the vibration plate.

6. The liquid ejection head according to claim 5, wherein the supply flow paths, the collection flow paths, the pressure chambers, and the integrated circuits are provided on a same side relative to the vibration plate.

7. The liquid ejection head according to claim 6, wherein a first region of the second substrate has provided thereon a plurality of first supply flow paths, a plurality of first collection flow paths, a plurality of the integrated circuits, and a plurality of first energy generating devices, a second region of the flow path substrate has provided thereon a plurality of second supply flow paths, a plurality of second collection flow paths, a plurality of second integrated circuits, and a plurality of second energy generating devices, and the first supply flow paths and the second supply flow paths have liquid supplied thereto from supply ports provided between the first region and the second region.

8. The liquid ejection head according to claim 7, wherein the first integrated circuits and the second integrated circuits are connected by wirings.

* * * * *